US009441321B2

(12) United States Patent
Yang et al.

(10) Patent No.: US 9,441,321 B2
(45) Date of Patent: Sep. 13, 2016

(54) BUBBLE GENERATING DEVICE AND WASHING MACHINE HAVING THE SAME

(75) Inventors: Byoung Yull Yang, Hwaseong-si (KR); Gyu Dong Jeon, Incheon (KR); Sang Yeon Pyo, Suwon-si (KR); Tai Eun Kim, Suwon-si (KR); Bo Ram Lee, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1246 days.

(21) Appl. No.: 13/368,871

(22) Filed: Feb. 8, 2012

(65) Prior Publication Data

US 2012/0204607 A1 Aug. 16, 2012

(30) Foreign Application Priority Data

Feb. 15, 2011 (KR) ..... 10-2011-0013168

(51) Int. Cl.
*D06F 33/02* (2006.01)
*D06F 35/00* (2006.01)

(52) U.S. Cl.
CPC ..... *D06F 35/002* (2013.01)

(58) Field of Classification Search
CPC ..... D06F 35/002
See application file for complete search history.

(56) References Cited

U.S. PATENT DOCUMENTS 3,060,713 A * 10/1962 Burkall ..... D06F 37/225 210/144
2009/0241267 A1 10/2009 Kim et al.
2010/0236000 A1* 9/2010 Kim ..... D06F 35/002 8/159
2010/0263410 A1* 10/2010 Oak ..... D06F 17/12 68/12.05

FOREIGN PATENT DOCUMENTS

| | | |
|---|---|---|
| CN | 101285254 | 10/2008 |
| CN | 102560969 | 7/2012 |
| JP | 2005-7224 | 1/2005 |
| JP | 2006-78159 | 3/2006 |
| JP | 2006-110091 | 4/2006 |
| KR | 1998-064029 | 11/1998 |
| KR | 20-2009-0003862 | 4/2009 |

OTHER PUBLICATIONS

Korean Office Action issued Apr. 30, 2015 in corresponding Korean Patent Application 10-2011-0013168.

(Continued)

*Primary Examiner* — Michael Barr
*Assistant Examiner* — Jason Riggleman
(74) *Attorney, Agent, or Firm* — Staas & Halsey LLP

(57) ABSTRACT

A bubble generating device and a washing machine equipped with the bubble generating device. The washing machine includes a water tub into which water is introduced, a bubble generating device to generate bubbles and supply the bubbles into the water tub, a pump to suck water from the water tub and supply the water into the bubble generating device, and a connecting pipe having an end connected to the bubble generating device and the other end connected to the water tub. The other end of the connecting pipe is located above a water level in the water tub. The bubble generating device selectively performs a bubble generating process in which bubbles are generated and supplied into the water tub, or a water circulating process in which water from the water tub circulates through the connecting pipe and flows back to the water tub.

14 Claims, 6 Drawing Sheets

(56) References Cited

OTHER PUBLICATIONS

Office Action mailed May 5, 2015 for corresponding Chinese Patent Application No. 201210034000.4.
European Search Report dated Nov. 8, 2012 and issued in corresponding European Patent Application 12155051.1.
Korean Office Action issued Oct. 6, 2015 in corresponding Korean Patent Application No. 10-2011-0013168.
Chinese Notice of Allowance issued Nov. 5, 2015 in corresponding Chinese Patent Application No. 201210034000.4.
European Office Action dated Feb. 11, 2016 in corresponding European Patent Application No. 12 155 051.1.

* cited by examiner

BUBBLE GENERATING DEVICE AND WASHING MACHINE HAVING THE SAME

CROSS-REFERENCE TO RELATED APPLICATIONS

This application claims the priority benefit of Korean Patent Application No. 10-2011-0013168, filed on Feb. 15, 2011 in the Korean Intellectual Property Office, the disclosure of which is incorporated herein by reference.

BACKGROUND

1. Field

Embodiments relate to a bubble generating device and a washing machine equipped with the bubble generating device.

2. Description of the Related Art

Generally, a washing machine includes a water tub into which water is introduced, and a rotary tub rotatably mounted in the water tub. Laundry is put into the rotary tub and then washed by the rotary tub rotating in the water tub.

Such a washing machine may further include a bubble generating device to achieve more efficient washing performance. The bubble generating device performs a function of mixing water and air to generate bubbles.

SUMMARY

It is an aspect of an embodiment or embodiments to provide a bubble generating device which is capable of circulating water.

It is another aspect of an embodiment or embodiments to provide a washing machine having the bubble generating device capable of circulating water.

Additional aspects of an embodiment or embodiments will be set forth in part in the description which follows and, in part, will be apparent from the description, or may be learned by practice.

In accordance with an aspect of an embodiment or embodiments, a washing machine includes a water tub into which water is introduced, a bubble generating device to generate bubbles and supply the bubbles into the water tub, a pump to suck water from the water tub and supply the water into the bubble generating device, and a first connecting pipe having an end connected to the bubble generating device and the other end connected to the water tub, the other end of the first connecting pipe being located above a water level in the water tub, wherein the bubble generating device selectively performs a bubble generating process in which bubbles are generated and supplied into the water tub, or a water circulating process in which water from the water tub circulates through the first connecting pipe and flows back to the water tub.

The bubble generating device may include a housing to form an external appearance of the bubble generating device, a switching passage formed in the housing, a switching device mounted in the switching passage to selectively direct water to the water tub or the first connecting pipe, and a driving device to drive the switching device, in which the bubble generating process or the water circulating process is selectively performed by operation of the switching device.

The washing machine may further include a second connecting pipe connected between the bubble generating device and the pump so that water from the pump flows into the bubble generating device therethrough. The housing may include a first connecting port connected with the second connecting pipe and formed with an orifice thereinside, a second connecting port connected with the water tub and defining the switching passage with the first connecting port therebetween, and a third connecting port connected between the switching passage and the first connecting pipe, wherein the switching device is rotatably mounted in the switching passage so that the switching device rotates to selectively direct water to the second connecting port or the third connecting port.

The switching device may include an opening/closing part to open and close the switching passage according to a rotating angle thereof, and a shaft provided at a portion of the opening/closing part, by which the switching device is rotatably mounted in the switching passage.

The driving device may include an actuator, a rack which performs a linear motion by operation of the actuator, and a pinion connected with the shaft and tooth-engaged with the rack, in which the pinion performs a rotary motion by the linear motion of the rack.

In accordance with another aspect of an embodiment or embodiments, a washing machine equipped with a bubble generating device includes a first connecting port into which water is introduced, a second connecting port out of which water is discharged, a third connecting port into which air is introduced or out of which water is discharged, and a switching passage formed between the first connecting port and the second connecting port and connected with the third connecting port, wherein when water flows to the second connecting port through the switching passage, air is introduced into the third connecting port, thereby generating bubbles, and when water flows to the third connecting port through the switching passage, the water circulates.

In accordance with a further aspect of an embodiment or embodiments, a bubble generating device includes a first connecting port into which water is introduced, a second connecting port out of which water is discharged, a third connecting port into which air is introduced or out of which water is discharged, and a switching passage formed between the first connecting port and the second connecting port, and connected with the third connecting port, wherein when water flows to the second connecting port through the switching passage, air is introduced into the third connecting port, thereby generating bubbles, and when water flows to the third connecting port through the switching passage, the water circulates.

As described above, the bubble generating device selectively performs a bubble generating process or a water circulating process in which water circulates through the bubble generating device. Accordingly, a pump configured to circulate water may be omitted.

BRIEF DESCRIPTION OF THE DRAWINGS

These and/or other aspects of an embodiment or embodiments will become apparent and more readily appreciated from the following description of the embodiments, taken in conjunction with the accompanying drawings of which.

DETAILED DESCRIPTION

Figure 1:
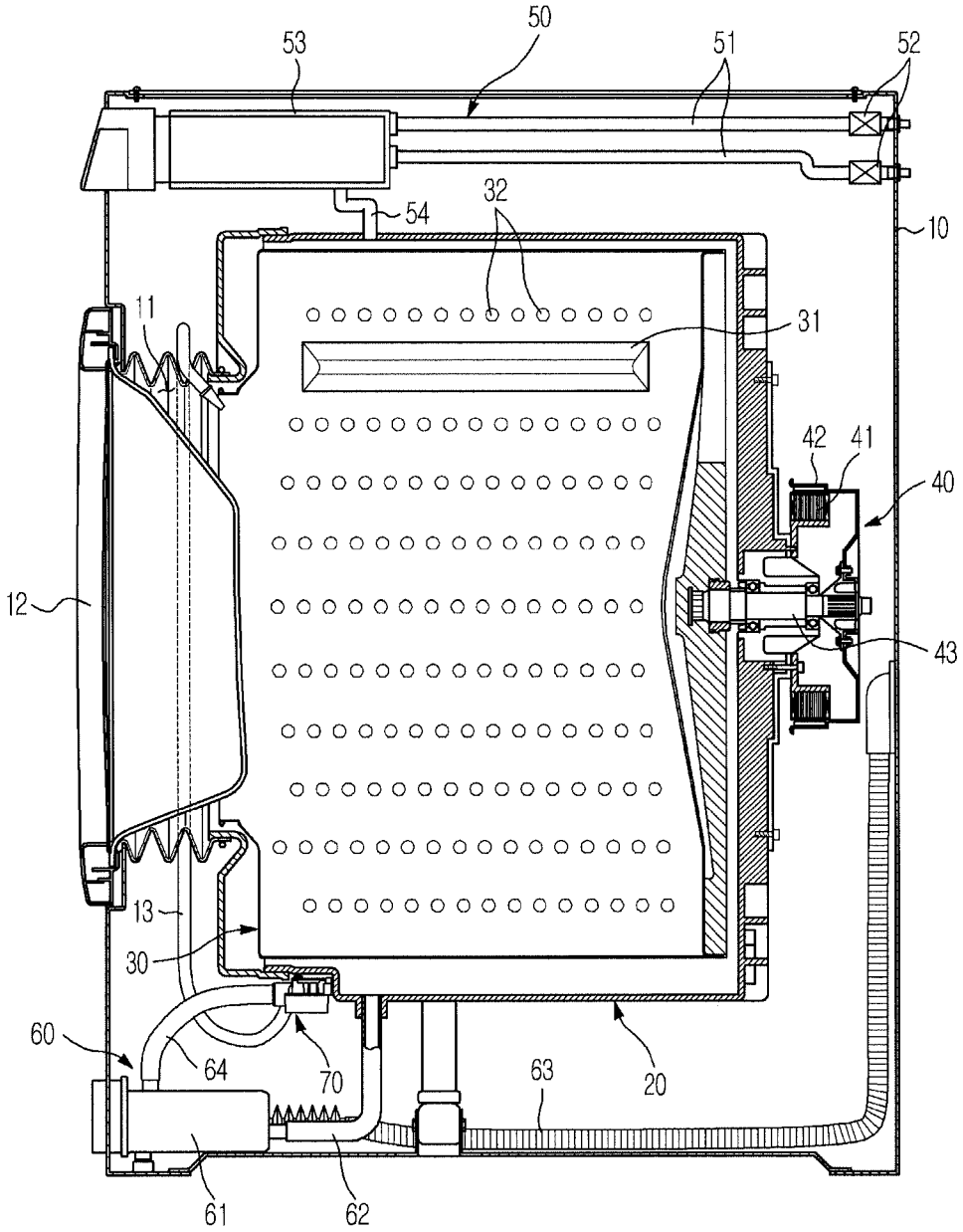
FIG. 1 is a schematic view showing a washing machine according to an embodiment.

Reference will now be made in detail to embodiments, examples of which are illustrated in the accompanying drawings, wherein like reference numerals refer to like elements throughout.

A washing machine according to an embodiment will be explained using a drum type washing machine as an example.

As shown in FIG. 1, a washing machine according to an embodiment includes a main frame 10 forming the external appearance of the washing machine, a water tub 20 suspended from the main frame 10, into which water is introduced, a rotary tub 30 rotatably mounted in the water tub 20, an introduction port 11, through which laundry is introduced into the rotary tub 30, a door 12 to open and close the introduction port 11, and a drive motor 40 mounted to a rear side of the water tub 20. The drive motor 40 generates a force to rotate the rotary tub 30.

The door 12 is opened, and laundry is then introduced into the rotary tub 30 through the introduction port 11. The drive motor 40 operates to rotate the rotary tub 30 so that the laundry in the rotary tub 30 is tumbled. The laundry is washed by this operation.

The rotary tub 30 is formed with holes 32, through which the water in the water tub 20 flows into the rotary tub 30. The rotary tub 30 is further provided with a lifter 31 thereinside to lift the laundry up.

The drive motor 40 includes a stator 41 mounted to the water tub 20, a rotor 42 capable of rotating by interaction with the stator 41, and a rotating shaft 43. One end of the rotating shaft 43 is connected to the rotor 42, and the other end of the rotating shaft 43 is connected to the rotary tub 30 through the rear side of the water tub 20. When the drive motor 40 operates, the rotating shaft 43 rotates together with the rotor 42, and thereby the rotary tub 30 rotates.

The washing machine further includes a water supply device 50 to supply water into the water tub 20, and a drain device 60 to drain water from the water tub 20. The water supply device 50 is mounted above the water tub 20, and the drain device 60 is mounted below the water tub 20.

The water supply device 50 includes a first water supply pipe 51 connected to an external water source, a water supply valve 52 to open and close the first water supply pipe 51, a detergent supply device 53 to mix detergent with the water supplied through the first water supply pipe 51, and a second water supply pipe 54 connected between the detergent supply device 53 and the water tub 20. The water mixed with the detergent flows into the water tub 20 through the second water supply pipe 54. The drain device 60 includes a pump 61 to suck the water out of the water tub 20, a first drain pipe 62 connected between the water tub 20 and the pump 61, and a second drain pipe 63 connected to the pump 61 and extending outside the main frame 10. The water in the water tub 20 drains via the first drain pipe 62, the pump 61 and the second drain pipe 63.

The washing machine further includes a bubble generating device 70, a first connecting pipe 13 and a second connecting pipe 64. The bubble generating device 70 is mounted under the water tub 20. The bubble generating device 70 generates bubbles and supplies the same to the water tub 20.

One end of the second connecting pipe 64 is connected to the bubble generating device 70 and the other end of the second connecting pipe 64 is connected to the pump 61, so that water from the pump 61 flows into the bubble generating device 70 through the second connecting pipe 64. One end of the first connecting pipe 13 is connected to the bubble generating device 70 and the other end of the first connecting pipe 13 is connected to the water tub 20. The other end of the first connecting pipe 13 is located above the water level in the water tub 20 so that air in the water tub 20 may be sucked into the bubble generating device 70 through the first connecting pipe 13. The water from the pump 61 and the air from the water tub 20 are mixed with each other in the bubble generating device 70, and thereby bubbles are generated. Consequently, the bubbles are supplied into the water tub 20.

In an embodiment, the bubble generating device 70 selectively performs a bubble generating process in which bubbles are generated by mixing the water from the pump 61 with air, and the bubbles are supplied into the water tub 20, or a water circulating process in which the water from the water tub 20 circulates through the first connecting pipe 13 and flows back to the water tub 20.

Figure 2:
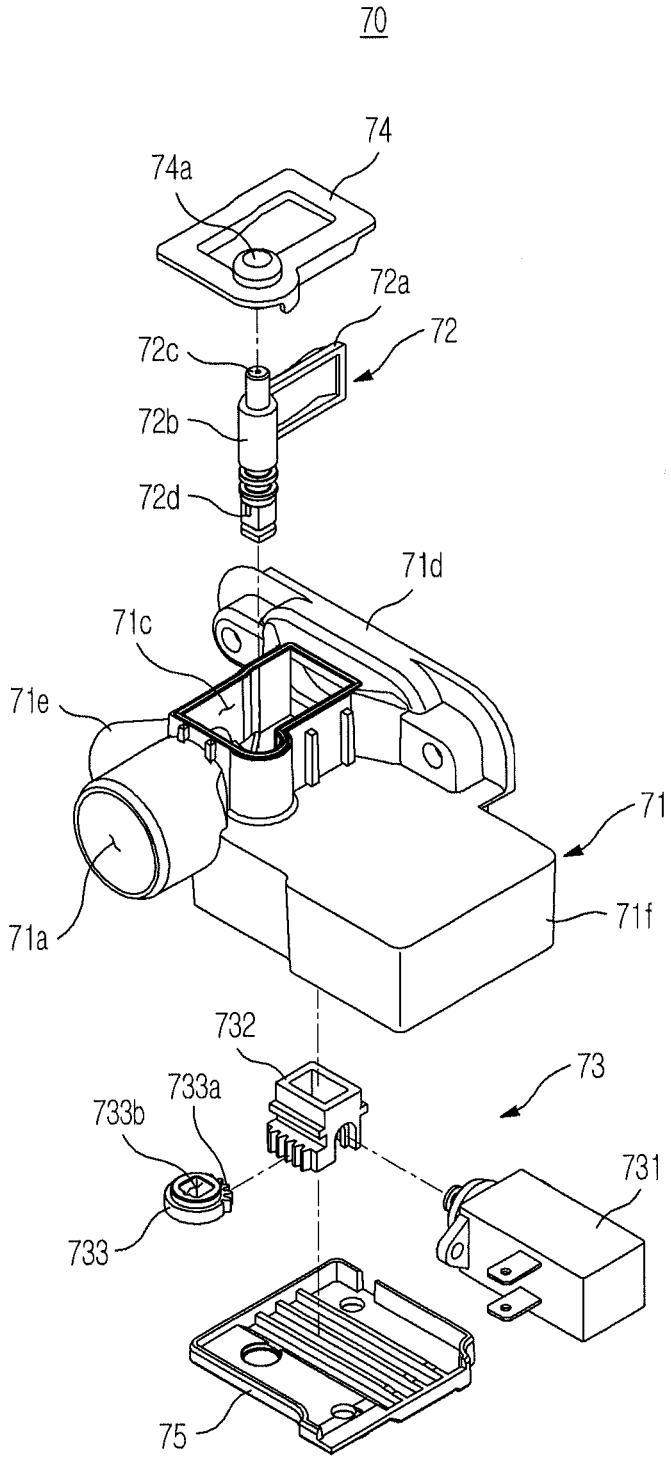
FIG. 2 is an exploded perspective view showing a bubble generating device for the washing machine according to an embodiment.

As shown in FIG. 2, the bubble generating device 70 includes a housing 71 forming the external appearance of the bubble generating device 70, a switching device 72 mounted in the housing 71, and a driving device 73 to drive the switching device 72. By the operation of the switching device 72, the bubble generating process or the water circulating process is selectively performed.

The housing 71 includes a first connecting port 71*a* connected with the second connecting pipe 64, a second connecting port 71*d* connected with the water tub 20, a switching passage 71*c* formed between the first connecting port 71*a* and the second connecting port 71*d* to connect the same to each other, and a third connecting port 71*e* provided between the first connecting pipe 13 and the switching passage 71*c* to connect the same to each other. The first connecting port 71*a* is formed with an orifice 71*b* (refer to FIG. 3) having a reduced diameter. The second connecting port 71*d* is formed in alignment with the orifice 71*b* of the first connecting port 71*a* and the switching passage 71*c*. The water introduced into the first connecting port 71*a* flows straight to the water tub 20 through the orifice 71*b*, the switching passage 71*c* and the second connecting port 71*d*. The third connecting port 71*e* is connected to the switching passage 71*c*, being tilted by a predetermined angle with respect to the water-flow direction. The air in the water tub 20 is introduced into the third connecting port 71*e* through the first connecting pipe 13, or the water is introduced into the first connecting pipe 13 through the third connecting port 71*e*. The switching device 72 is rotatably mounted in the switching passage 71*c*. The switching device 72 rotates to selectively allow the water passing through the orifice 71*b* to flow toward the second connecting port 71*d* or the third connecting port 71*e*.

The switching passage 71*c* of the housing 71 has an upper portion which is opened to receive the switching device 72 thereinside. The bubble generating device 70 further includes a first cover 74 to cover the upper portion of the switching passage 71*c*. The housing 71 has an accommodating part 71*f* to receive the driving device 73 thereinside. The accommodating part 71*f* is formed at a lower portion of the housing 71. The accommodating part 71*f* has a lower portion which is opened for the installation of the driving device 73. The bubble generating device 70 further includes a second cover 75 to cover the lower portion of the accommodating part 71*f*.

The switching device 72 rotates to selectively direct the water passing through the first connecting port 71*a* to the second connecting port 71*d* or the third connecting port 71*e*. The switching device 72 includes an opening/closing part 72*a* to open and close the switching passage 71*c*, a shaft 72*b* provided at a portion of the opening/closing part 72*a*, by which the switching device 72 may be rotatably mounted in the switching passage 71*c*, a connecting part 72*d* provided at a lower end of the shaft 72*b* and having a polygonal shape, and a protruding part 72*c* provided at an upper end of the shaft 72*b*. The protruding part 72*c* of the switching device 72 is inserted into a hinge part 74*a* provided at the first cover 74.

The driving device 73 includes an actuator 731, a rack 732 connected to the actuator 731, and a pinion 733 tooth-engaged with the rack 732. As the actuator 731 operates, the rack 732 performs a linear motion and accordingly the pinion 733 performs a rotary motion. The pinion 733 includes a plurality of teeth 733*a* engaged with the rack 732, and a connecting hole 733*b* having a polygonal shape corresponding to the shape of the connecting part 72*d* of the switching device 72. The connecting part 72*d* of the switching device 72 is fitted into the connecting hole 733*b* of the pinion 733 so that the switching device 72 may rotate by the rotary motion of the pinion 733.

Hereinafter, the operation of the bubble generating device of the washing machine with the above-stated construction will be described in detail with reference to the accompanying drawings.

Figure 3:
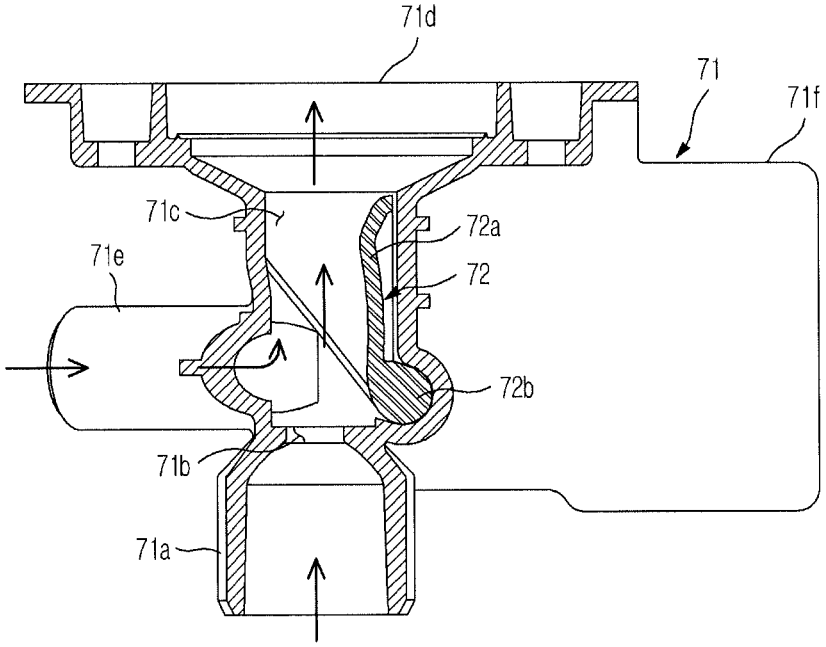
FIGS. 3 and 4 are sectional views showing the operation of the bubble generating device for the washing machine according to an embodiment.

First, when the bubble generating process in which bubbles are generated from the bubble generating device 70 needs to be performed, the actuator 731 is not activated, but the pump 61 is activated to supply the water to the bubble generating device 70 through the second connecting pipe 64. While the actuator 731 does not operate, the opening/closing part 72*a* of the switching device 72 rotates by the water passing through the orifice 71*b* and becomes parallel with the switching passage 71*c* as shown in FIG. 3. In this state, since the water passing through the orifice 71*b* flows in the switching passage 71*c* at a high speed, the pressure in the switching passage 71*c* is decreased by the Bernoulli's law. When the pressure in the switching passage 71*c* falls below atmospheric pressure, the air in the water tub 20 is sucked into the switching passage 71*c* through the first connecting pipe 13 connected to the third connecting port 71*e*. The water and the air are mixed with each other in the switching passage 71*c*, and accordingly bubbles are generated. Consequently, the bubbles are supplied into the water tub 20 through the second connecting port 71*d*.

Figure 5:
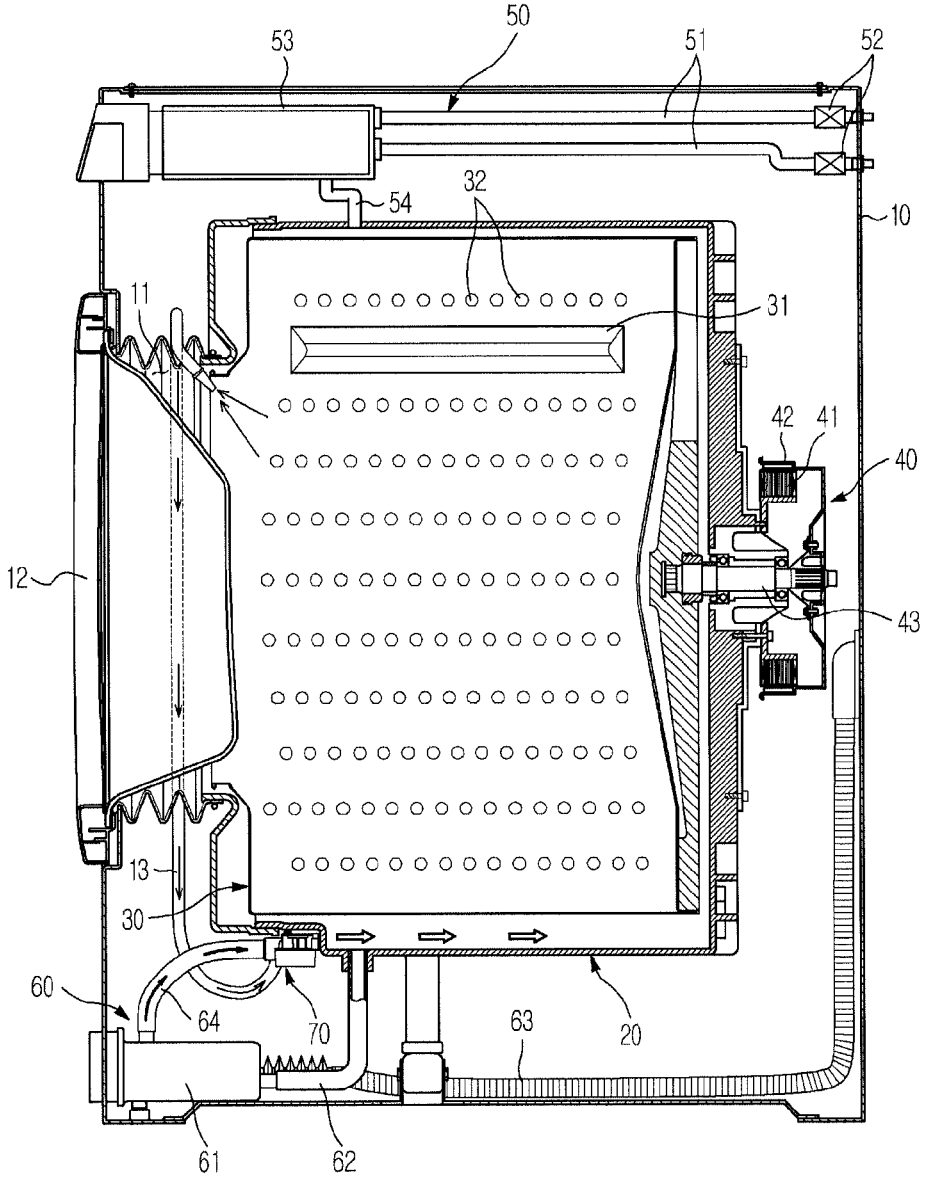
FIGS. 5 and 6 are sectional views showing the operation of the washing machine according to an embodiment.

As shown in FIG. 5, when the bubble generating process is performed by the bubble generating device 70, the water in the water tub 20 is sucked into the pump 61 and then flows into the bubble generating device 70 through the second connecting pipe 64. At the same time, the air in the water tub 20 is sucked into the bubble generating device 70 through the first connecting pipe 13, and is then mixed with the water from the pump 61. As a result, bubbles are generated in the bubble generating device 70, and the bubbles are supplied into the water tub 20.

Next, when the water circulating process in which the water circulates through the bubble generating device 70 needs to be performed, the actuator 731 is activated and the pump 61 pumps the water to the bubble generating device 70 through the second connecting pipe 64.

Figure 4:
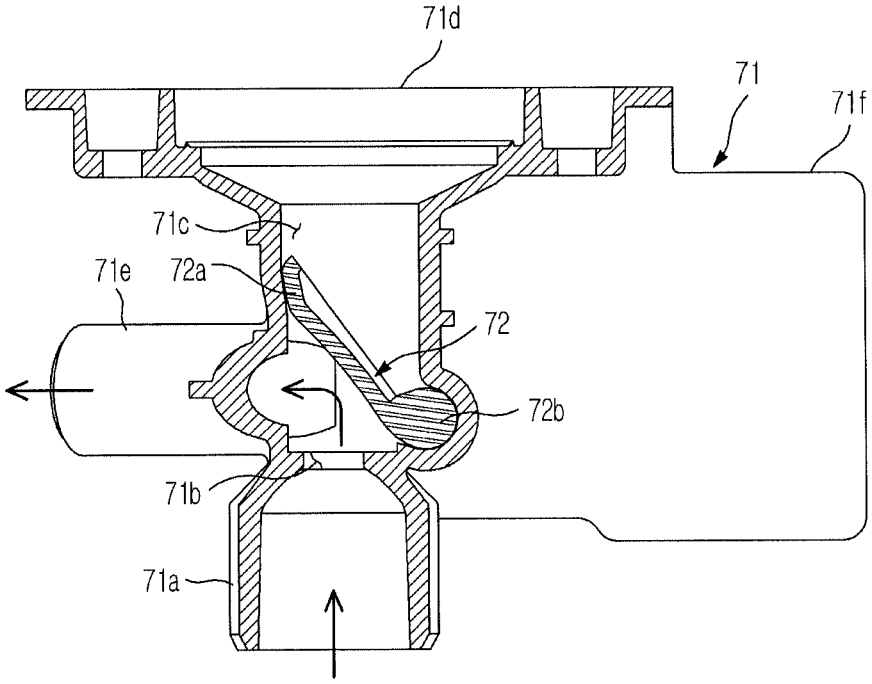

As the actuator 731 operates, the rack 732 performs a linear motion and accordingly the pinion 733 performs a rotary motion. Because the connecting part 72*d* of the switching device 72 is connected to the pinion 733, the switching device 72 rotates by the rotary motion of the pinion 733. As shown in FIG. 4, the opening/closing part 72*a* of the switching device 72 blocks a middle portion of the switching passage 71*c*.

In such a state that the switching passage 71*c* is blocked, the water introduced into the first connecting port 71*a* through the second connecting pipe 64 flows to the first connecting pipe 13 through the third connecting port 71*e*. Consequently, the water is introduced back into the upper portion of the water tub 20 through the first connecting pipe 13.

Figure 6:
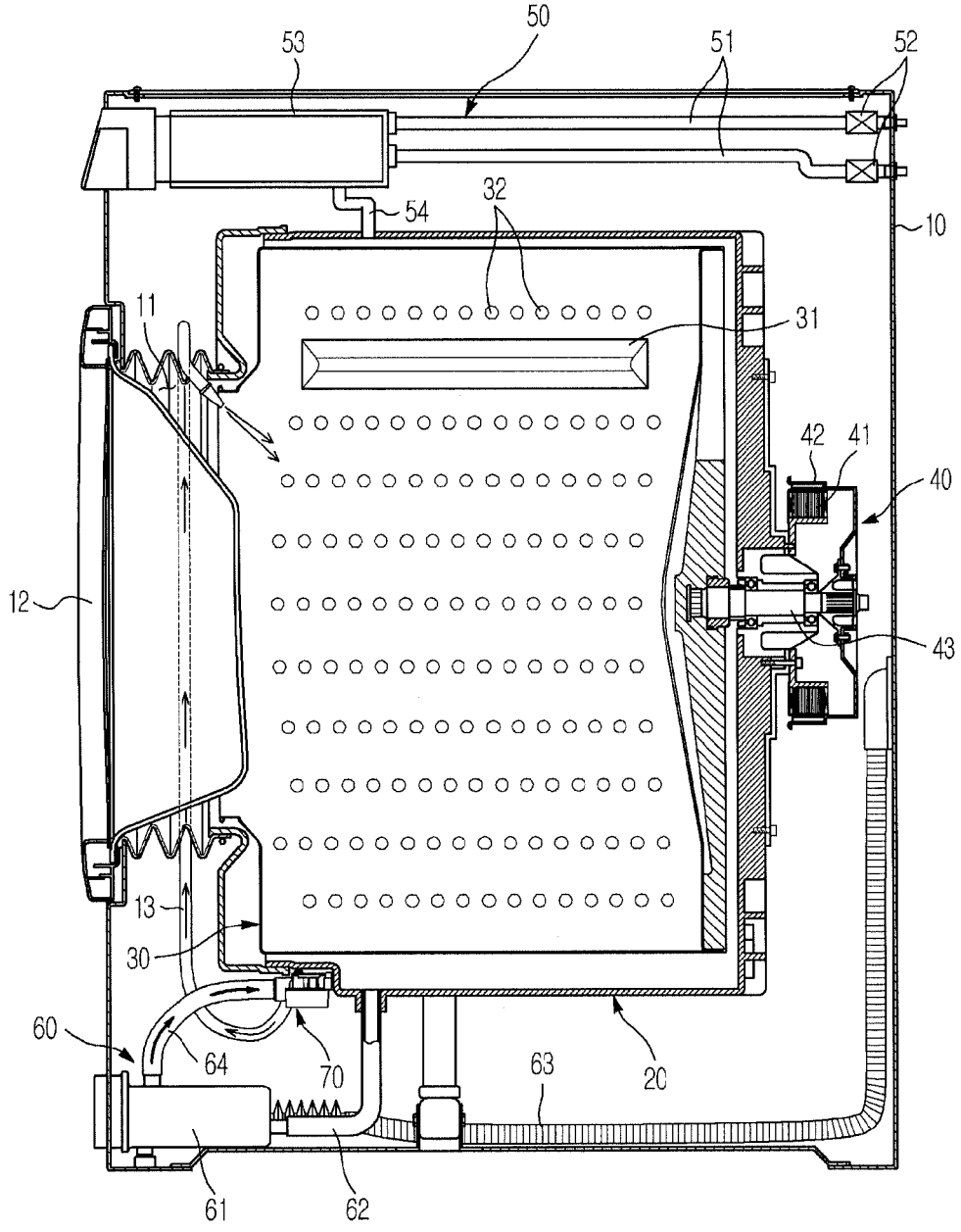

As shown in FIG. 6, when the water circulating process is performed by the bubble generating device 70, the water in the water tub 20 is sucked into the pump 61 and is pumped to the bubble generating device 70 through the second connecting pipe 64. Consequently, the water flows back to the water tub 20 through the first connecting pipe 13 from the bubble generating device 70.

The washing machine according to an embodiment, may have the first connecting pipe 13 is connected to the third connecting port 71*e* of the bubble generating device 70, in which bubbles are generated by mixing the air sucked through the first connecting pipe 13 with the water pumped from the pump 61 or the water circulates through the first connecting pipe 13 without generating bubbles, but it is not restricted thereto. For example, the washing machine may have the first drain pipe is connected to the third connecting port, in which the bubble generating device performs the operation of generating bubbles by mixing the air and the water sucked through the first drain pipe or the operation of draining the water outside the main frame through the first drain pipe.

The bubble generating device according to an embodiment may have the pinion 733 rotates by the rack 732 moving linearly by the actuator 731, but it is not restricted thereto. For example, the bubble generating device may have the pinion performs a rotary motion by a motor.

Although some embodiments have been shown and described, it would be appreciated by those skilled in the art that changes may be made in embodiments without departing from the principles and spirit, the scope of which is defined in the claims and their equivalents.

What is claimed is:

1. A washing machine comprising:

a water tub into which water is introduced;

a bubble generating device to generate bubbles and supply the bubbles into the water tub;

a pump to suck water from the water tub and supply the sucked water into the bubble generating device; and a first connecting pipe having an end connected to the bubble generating device and the other end connected to the water tub and being located above a water level in the water tub, wherein the bubble generating device selectively performs a bubble generating process in which bubbles are generated and supplied into the water tub, or a water circulating process in which the sucked water from the water tub circulates through the first connecting pipe and flows back to the water tub, and wherein the bubble generating device includes a housing to form an external appearance of the bubble generating device, a switching passage formed in the housing, a switching device mounted in the switching passage to selectively direct water to the water tub or the first connecting pipe, and a driving device to drive the switching device, in which the bubble generating process or the water circulating process is selectively performed by an operation of the switching device.

2. The washing machine according to claim 1, further comprising a second connecting pipe connected between the bubble generating device and the pump so that water from the pump flows into the bubble generating device therethrough, wherein the housing includes a first connecting port connected with the second connecting pipe and formed with an orifice thereinside, a second connecting port connected with the water tub and defining the switching passage with the first connecting port therebetween, and a third connecting port connected between the switching passage and the first connecting pipe, and wherein the switching device is rotatably mounted in the switching passage so that the switching device rotates to selectively direct water to the second connecting port or the third connecting port.

3. The washing machine according to claim 1, wherein the switching device includes an opening/closing part to open and close the switching passage according to a rotating angle thereof, and a shaft provided at a portion of the opening/closing part, by which the switching device is rotatably mounted in the switching passage.

4. The washing machine according to claim 3, wherein the driving device includes an actuator, a rack which performs a linear motion by an operation of the actuator, and a pinion connected with the shaft and tooth-engaged with the rack, in which the pinion performs a rotary motion by the linear motion of the rack.

5. A washing machine, comprising:

a water tub into which water is introduced;

a bubble generating device to generate bubbles and supply the bubbles into the water tub, the bubble generating device comprising:

a first connecting port into which water is introduced;

a second connecting port from which water is discharged;

a third connecting port into which air is introduced during a bubble generating process or from which water is discharged during a water circulation process; and a switching passage formed between the first connecting port and the second connecting port, and connected with the third connecting port;

a pump to suck water from the water tub and supply the sucked water into the bubble generating device;

a first connecting pipe having an end connected to the third connecting port and the other end connected to the water tub, the other end of the first connecting pipe being located above a water level in the water tub; and a second connecting pipe connected to the first connecting port to supply water from the pump into the bubble generating device therethrough, wherein when water flows to the second connecting port through the switching passage, air is introduced into the third connecting port, thereby generating bubbles, and when water flows to the third connecting port through the switching passage, the water circulates through the first connecting pipe and flows back to the water tub.

6. The washing machine according to claim 5, wherein the bubble generating device further comprises:

a switching device mounted in the switching passage to selectively direct water to the second connecting port or the third connecting port; and a driving device to drive the switching device.

7. The washing machine according to claim 6, wherein the switching device includes an opening/closing part to open and close the switching passage according to a rotating angle thereof, and a shaft provided at a portion of the opening/closing part, by which the switching device is rotatably mounted in the switching passage.

8. The washing machine according to claim 7, wherein the driving device includes an actuator, a rack which performs a linear motion by an operation of the actuator, and a pinion connected with the shaft and tooth-engaged with the rack, in which the pinion performs a rotary motion by the linear motion of the rack.

9. The washing machine according to claim 6, wherein the first connecting port includes an orifice.

10. A washing machine having a bubble generating device, comprising:

a water tub into which water is introduced;

the bubble generating device to generate bubbles and supply the bubbles into the water tub, the bubble generating device comprising:

a first connecting port into which water is introduced;

a second connecting port from which the introduced water is discharged;

a third connecting port into which air is introduced during a bubble generation process or from which water is discharged during a water circulation process; and a switching passage formed between the first connecting port and the second connecting port and connected with the third connecting port;

a pump to suck water from the water tub and supply the sucked water into the bubble generating device;

a first connecting pipe having an end connected to the third connecting port and the other end connected to the water tub, the other end of the first connecting pipe being located above a water level in the water tub; and a second connecting pipe connected to the first connecting port to supply water from the pump into the bubble generating device therethrough, wherein when water flows to the second connecting port through the switching passage, air is introduced into the third connecting port, thereby generating bubbles, and when water flows to the third connecting port through the switching passage, the water circulates through the first connecting pipe and flows back to the water tub.

11. The washing machine according to claim 10, wherein the bubble generating device further comprising a switching device mounted in the switching passage to selectively direct water to the second connecting port or the third connecting port; and a driving device to drive the switching device.

12. The washing machine according to claim 11, wherein the switching device includes an opening/closing part to open and close the switching passage according to a rotating angle thereof, and a shaft provided at a portion of the opening/closing part, by which the switching device is rotatably mounted in the switching passage.

13. The washing machine according to claim 12, wherein the driving device includes an actuator, a rack which performs a linear motion by an operation of the actuator, and a pinion connected with the shaft and tooth-engaged with the rack, in which the pinion performs a rotary motion by the linear motion of the rack.

14. The washing machine according to claim 11, wherein the first connecting port includes an orifice.

* * * * *